United States Patent [19]

Delk et al.

[11] 4,258,512

[45] Mar. 31, 1981

[54] HOUSING UNIT FORMED FROM MOBILE OR MODULAR PARTS

[75] Inventors: Charles W. Delk, Walnut Creek; Lee H. Brandenburg, Woodside; Edwin J. Parish, San Jose, all of Calif.

[73] Assignee: The Immobile Home Company, San Jose, Calif.

[21] Appl. No.: 908,619

[22] Filed: May 23, 1978

[51] Int. Cl.[3] ..... E04H 1/00

[52] U.S. Cl. ..... 52/79.7; 52/79.9

[58] Field of Search ..... 52/79.1, 143, 169.3, 52/169.2, 79.7, 79.6, 79.9

[56] References Cited

U.S. PATENT DOCUMENTS

| | | | |
|---|---|---|---|
| 2,795,014 | 6/1957 | Kelly | 52/79.7 |
| 2,990,588 | 7/1961 | McKinley | 52/143 |
| 3,407,548 | 10/1968 | Russell | 52/79.6 X |
| 3,427,645 | 2/1969 | Sproul | 52/169.3 |
| 3,678,639 | 7/1972 | Panitz | 52/79.1 |
| 3,830,024 | 8/1974 | Warnke | 52/143 X |
| 3,835,600 | 9/1974 | Padula et al. | 52/143 X |
| 3,874,137 | 4/1975 | Gentry | 52/169.3 |
| 4,102,091 | 7/1978 | Farge | 52/79.7 |

FOREIGN PATENT DOCUMENTS 2420845 12/1974 Fed. Rep. of Germany .

*Primary Examiner*—James A. Leppink
*Assistant Examiner*—Carl D. Friedman
*Attorney, Agent, or Firm*—John L. McGannon

[57] ABSTRACT

A housing unit having a pair or more of mobile or modular home parts of unequal lengths and connected together and supported or piers or a foundation. A garage is in longitudinal alignment with the shorter home part and has a member of load bearing walls supported on a concrete slab and erected adjacent to respective home parts. One entire side of the housing unit is free of doors, windows or other openings and this side can have one side boundary in or immediately adjacent to the lot line to maximize the size of the remainder of the lot for open or useable space, i.e. a garden courtyard or yard. Several embodiments of the housing unit are disclosed.

This invention relates to improvements in the construction of housing, and more particularly, to a housing unit made from prefabricated mobile or modular housing sections.

7 Claims, 14 Drawing Figures

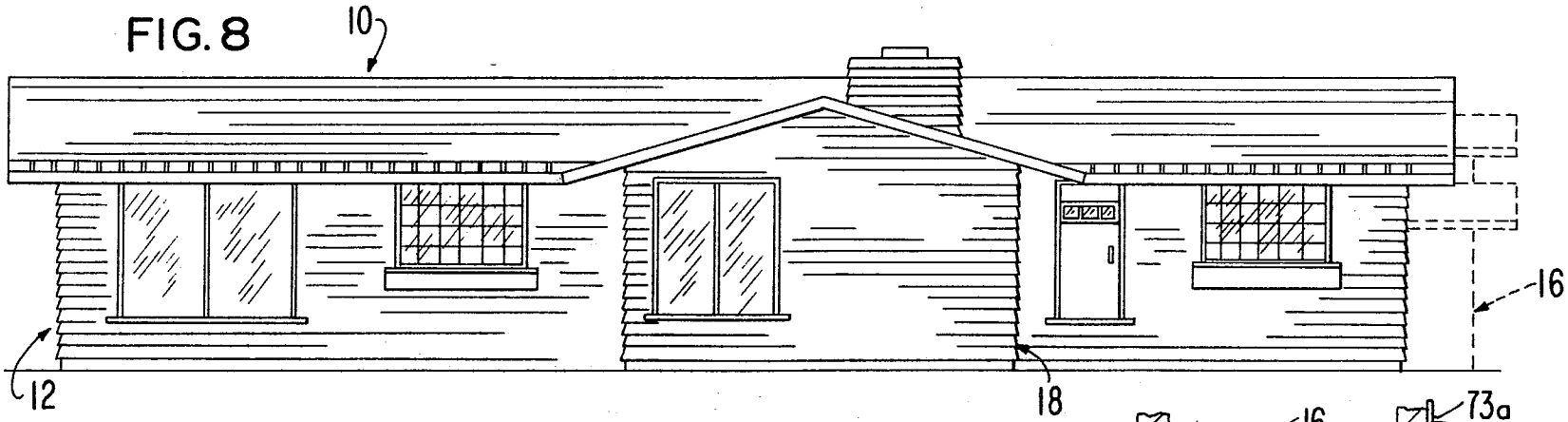
FIG. 8
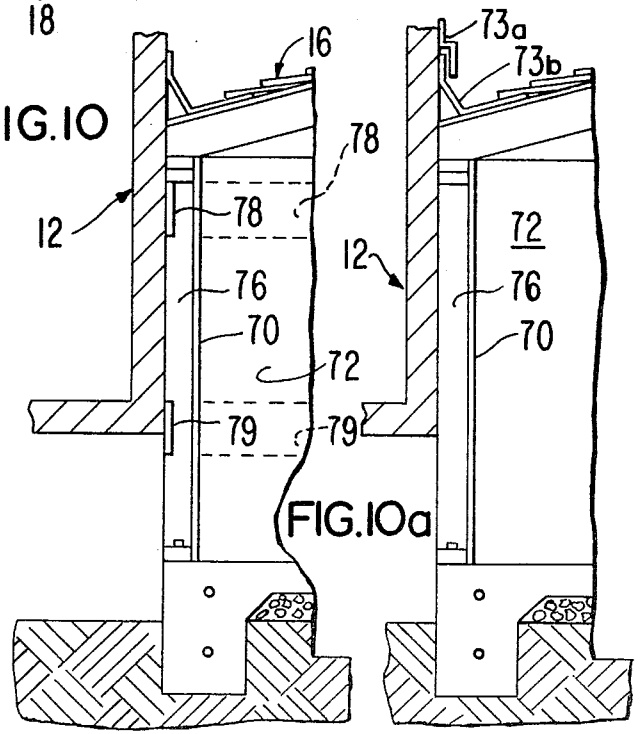
FIG. 10
FIG. 10a
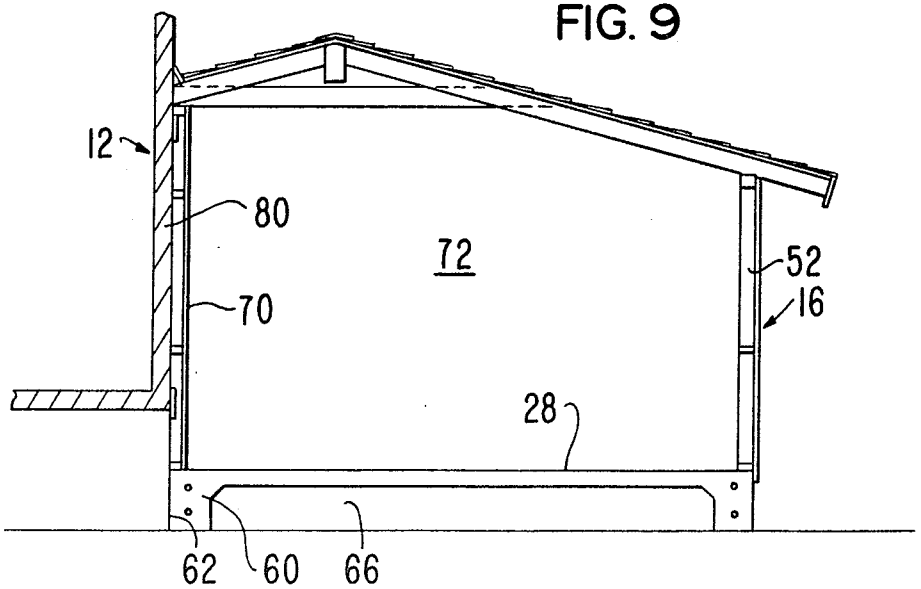
FIG. 9

HOUSING UNIT FORMED FROM MOBILE OR MODULAR PARTS

BACKGROUND OF THE INVENTION

Present day mobile homes have been made by placing two or more mobile or modular housing sections or home parts on piers or foundations and then interconnecting the parts so that they mate to form a composite unit which has living space of a size dependent upon the dimensions of the parts themselves. The technique of placing the home parts on piers or foundations and then interconnecting the home parts is not new and is well-known in the art.

Heretofore, housing assemblies of the type mentioned above have been generally placed in the center of the lot and, since such lots are relatively long and narrow to achieve a relatively high density, the space on each side of such a housing assembly which, for instance, might be 24 feet wide, is available only for limited use. In fact, the space on one side of the housing assembly is usually only wide and deep enough to park two or three vehicles in tandem and the space on the opposite side of the housing assembly is too narrow to permit much activity other than permitting entrance to and egress from the housing assembly itself. As for protecting the vehicles, the most that has been provided with conventional housing assemblies of this type has been a carport or the like providing merely a roof for the vehicles. There has been no garage either permanently attached or attached only by a flashing to such a housing assembly which has at least two house parts or unequal length. Moreover, except for the possible use of fences, there have been substantially no attempts to provide complete privacy for the occupants of adjacent housing assemblies.

In view of the foregoing shortcomings of conventional mobile and modular homes, a need has arisen for an improved housing unit which provides indoor-outdoor living, parking and open space advantages not heretofore available.

SUMMARY OF THE INVENTION

The present invention satisfies the aforesaid need by providing a housing unit suitable for use on a long and narrow lot of a mobile or modular home park or housing subdivision to provide maximum open or useable space on the remaining part of the lot yet the construction of the housing unit assures complete privacy to the occupant of the adjacent lot notwithstanding the narrowness of the lots and the relatively high density of housing units in the mobile home part or subdivision. In a first embodiment, the housing unit has an attached garage which operates to at least partially support a pair of home parts of unequal length which form elements of the housing unit. In a second embodiment, the housing unit has a garage adjacent to a pair of home parts of unequal length, with the garage being coupled to at least one of the home parts only by a flashing which permits relative vertical movement between each home part and the garage.

To this end, the home parts, which are initially movable onto a lot in the sense that they are either mobile, i.e., with wheels, or modular, i.e., hauled on trucks or trailers, are supported on piers or foundations and interconnected to form the shell for the housing unit. The garage, formed in place usually after the home parts are connected together, includes a concrete or other slab and a garage housing above the slab. In the first embodiment, the garage housing has a pair or more of walls which are supported on the slab and are connected to the adjacent portions of the home parts. Thus, these walls are load bearing members and are used to support the portions of the home parts adjacent thereto in the event of ground subsidence. In the second embodiment, the garage housing is not in load-bearing relationship to the home parts but is coupled to one or both of the home parts with a flashing which permits the home parts to move vertically through a limited distance relative to the garage housing due to ground subsidence.

One entire side of the housing unit, the side which is closest to the lot line, is free of doors, windows or other openings; thus, the occupants of the lot and housing unit adjacent to said side have complete privacy from the occupants of the first-mentioned housing unit, thereby permitting full enjoyment of the lot and housing unit thereon.

A number of design variations of the housing unit can be formed in accordance with the teachings of the present invention. For instance, in addition to the two or more mobile or modular home parts, each housing unit can include a third or more home parts connected to the side or end of the other two home parts. This will provide additional room space for the housing unit without using a substantial part of the open and useable space on the remainder of the lot.

The primary object of this invention is to provide an improved housing unit using initially movable, factory made home parts, wherein the housing unit has a garage which in essence, acts as an attached garage yet the garage may or may not be load-bearing as to the home parts, and the housing unit can be constructed and arranged on a lot to provide substantially complete privacy for the occupants of adjacent lots.

Another object of the present invention is to provide a housing unit of the type described, wherein the home parts are of unequal length and the garage is longitudinally aligned with the shorter home part so that a sidewall and an end wall of the garage housing can either be connected to the home parts in load-bearing relationship thereto or merely connected by flashing to compensate for subsidence of the soil beneath the housing unit.

Yet another object of of this invention is to provide a housing unit of the aforesaid character, wherein one entire side of the housing unit can be located adjacent to or on the lot line and also can be free of doors, windows or other openings to assure maximum open or useable space on the remainder of the lot yet provide complete privacy for the occupants of an adjacent lot.

Other objects of this invention will become apparent as the following specification progresses, reference being had to the accompanying drawings for an illustration of several embodiments of the invention.

IN THE DRAWINGS

Figure 2:
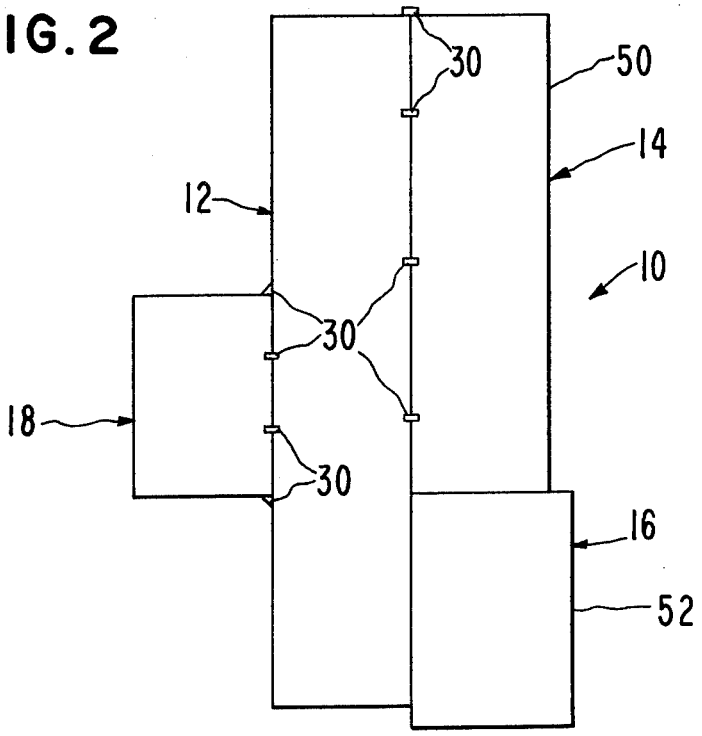
FIG. 2 is a view similar to FIG. 1, but showing the three parts and the garage of the housing unit connected together.
Figure 2A:
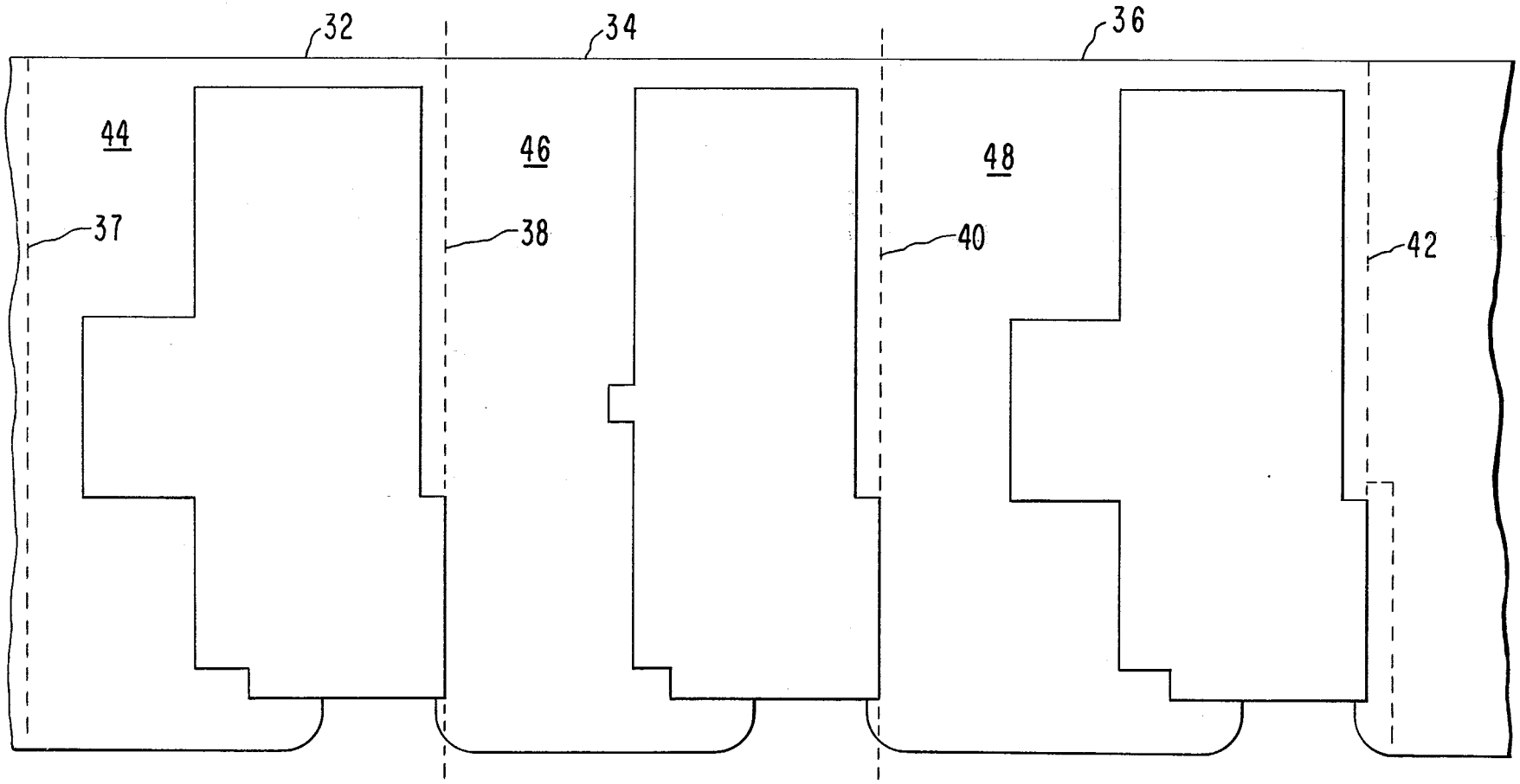
Figure 3:
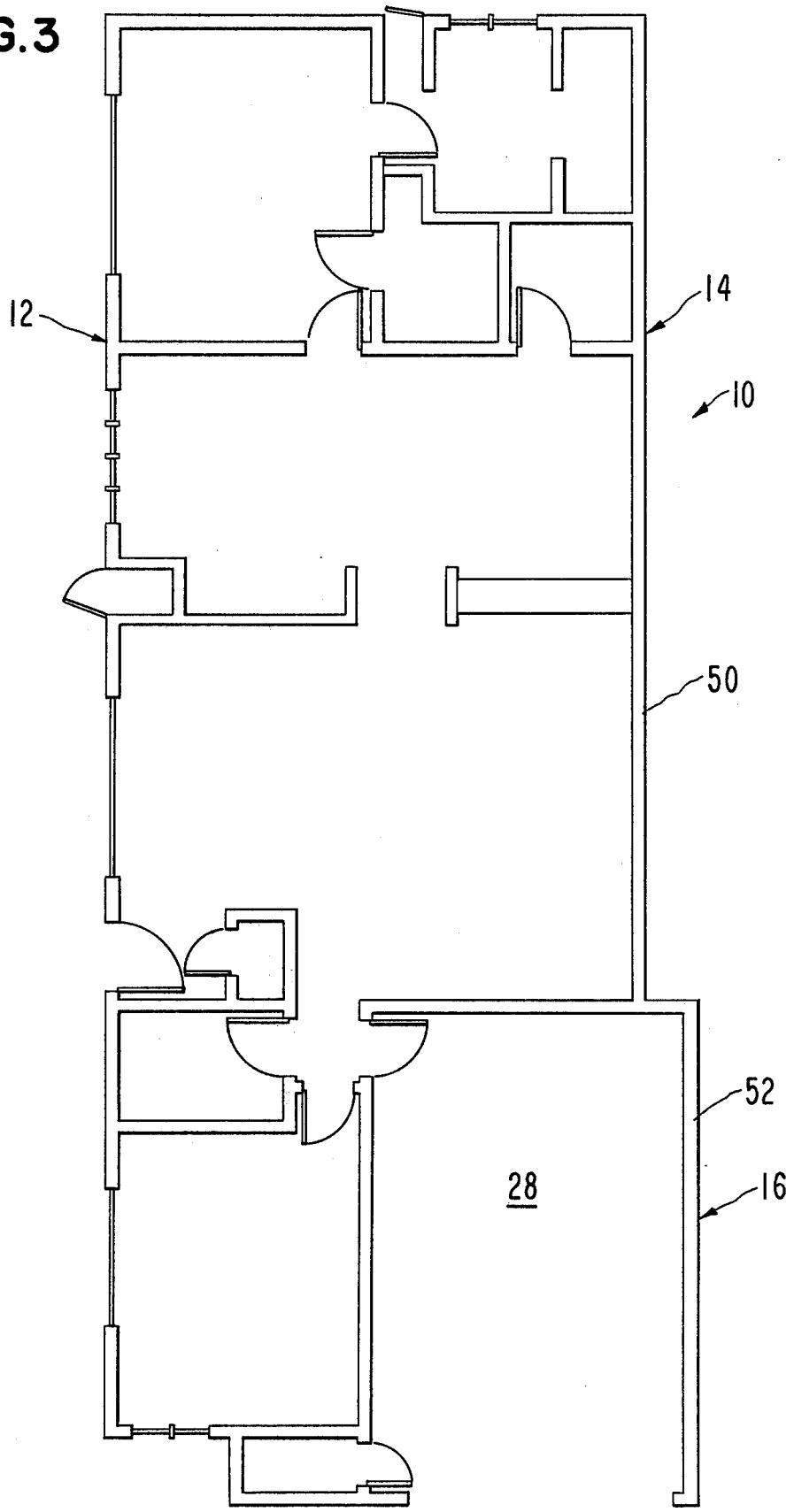
Figure 4:
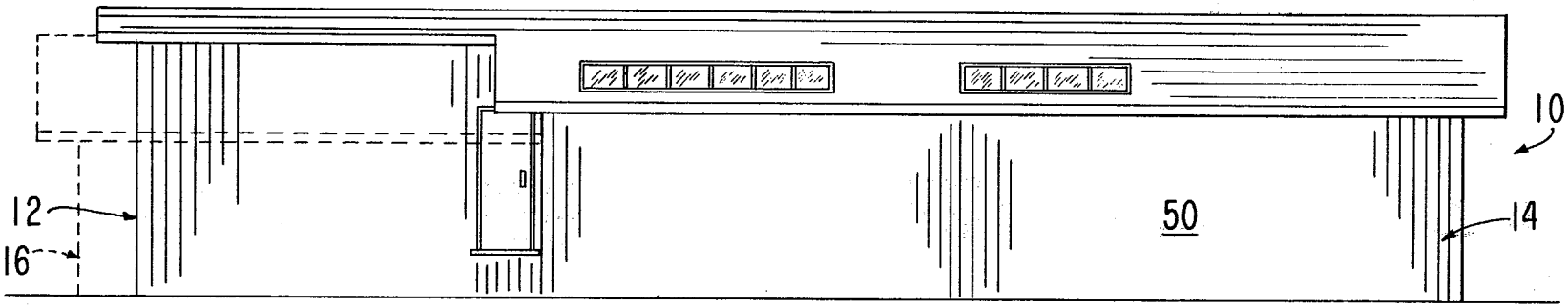
Figure 5:
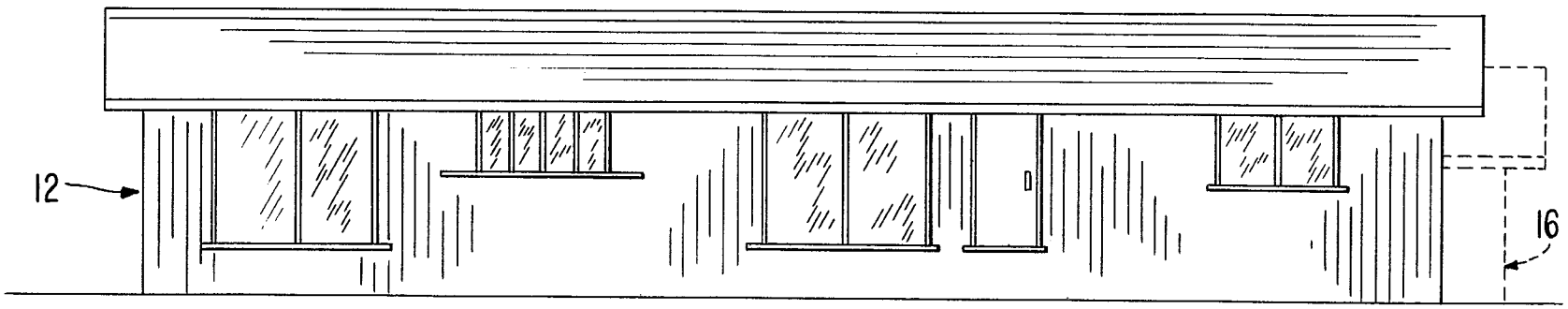
Figure 6:
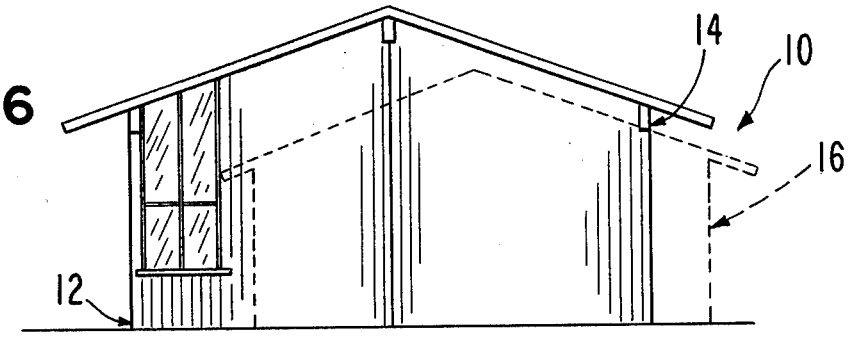
Figure 11:
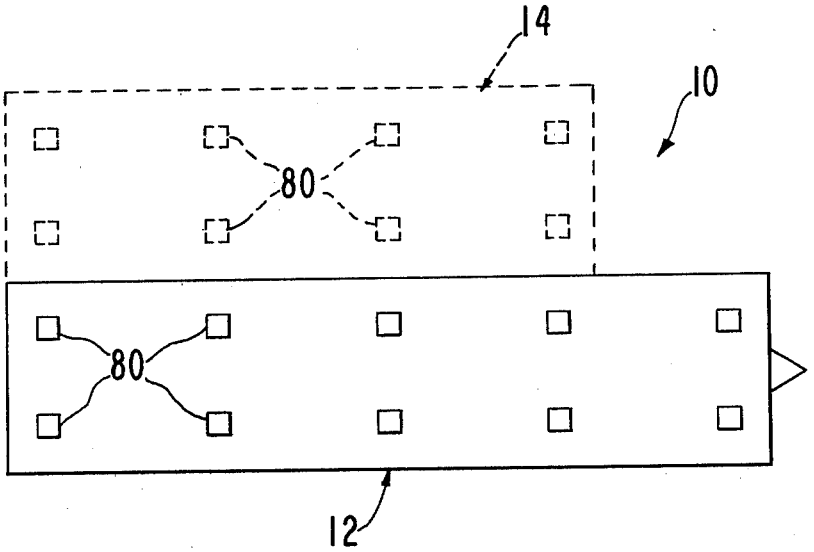
Figure 12:
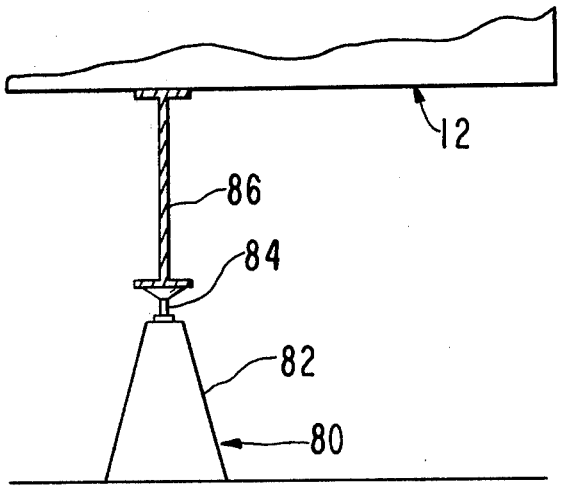
Figure 7:
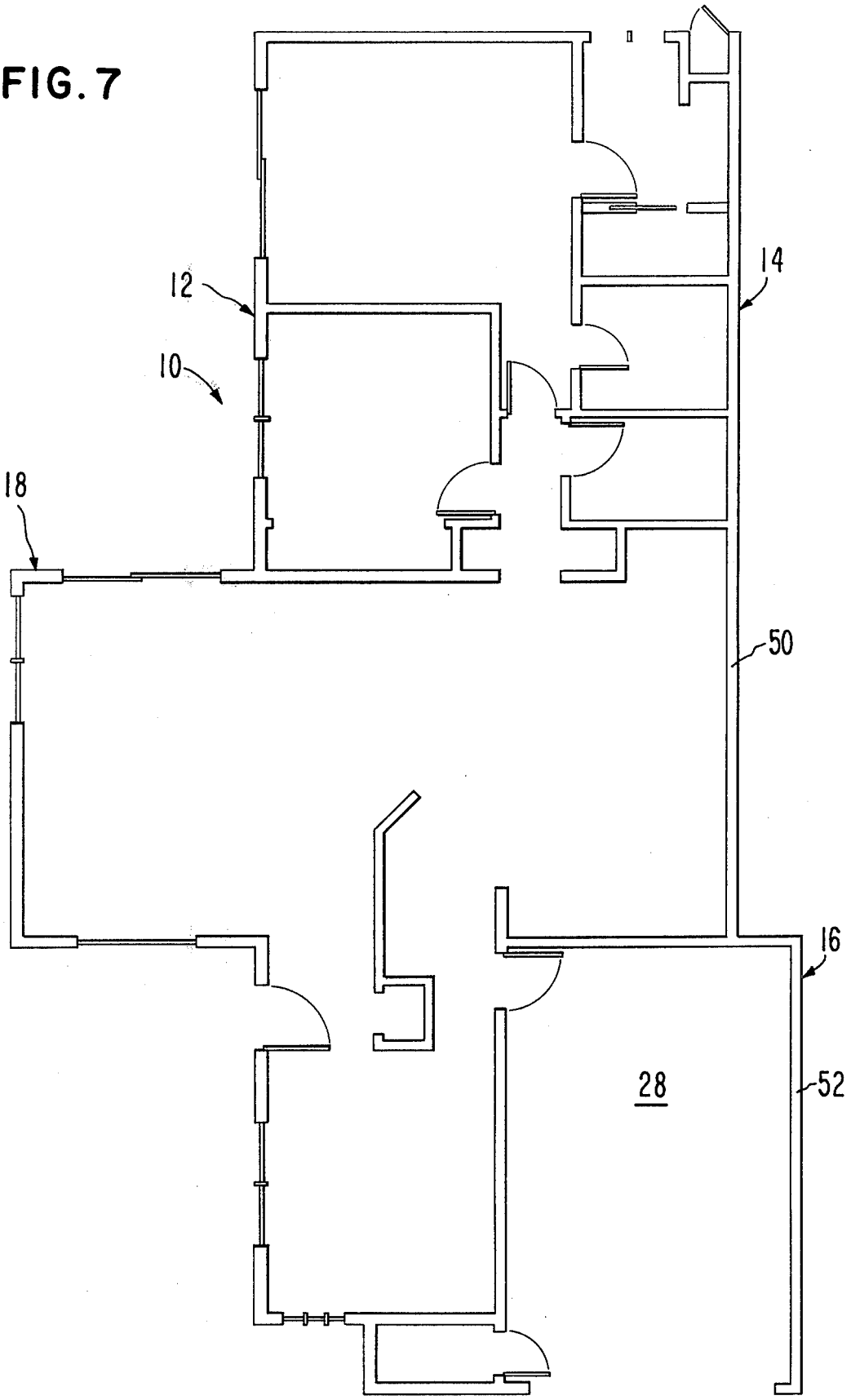

FIG. 2*a* is an enlarged plan view of three adjoining lots showing housing units of the present invention thereon;

FIG. 3 is a floor plan of one of the housing units of the present invention;

FIG. 4 is an elevational view of one side of the housing unit of FIG. 3 showing the housing unit in a finished condition with the garage shown in dashed lines;

FIG. 5 is a view similar to FIG. 4, but showing the opposite side of the finished housing unit of FIG. 3;

FIG. 6 is an end elevational view of the finished housing unit of FIGS. 3–5, looking in the direction of the attached garage thereof;

FIG. 7 is a view similar to FIG. 3, but showing the floor plan of a second housing unit of the invention;

FIG. 8 is a view similar to FIG. 5, but showing one side of the finished housing unit of FIG. 7;

FIG. 9 is a fragmentary, cross-sectional view of one embodiment of the housing unit, showing the way in which the garage is attached to the home parts in load-bearing relationship thereto;

FIG. 10 is a view similar to FIG. 9, but on an enlarged scale to show the details of one wall of the garage part;

FIG. 10*a* is a view similar to FIG. 10 but showing a second embodiment of the housing unit with the garage coupled to one of the home parts by a flashing;

FIG. 11 is a view similar to FIG. 2, but showing possible locations of the piers for supporting the two home parts of the housing unit; and FIG. 12 is a side elevational view of one of the piers.

Figure 1:
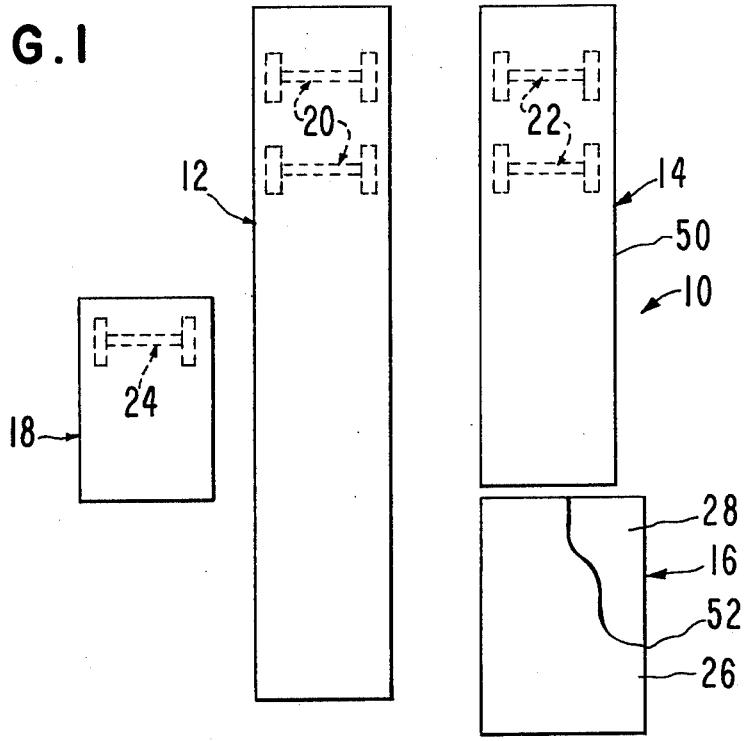
FIG. 1 is an exploded view in schemtic form of the housing unit of this invention showing three home parts and garage part separated from each other.

The housing unit of this invention is broadly denoted by the numeral 10 and is made basically of three parts, namely, a first home part 12, a second home part 14, and a garage or garage part 16. As shown in FIG. 1, these three parts are separated from each other but are brought together to form a unitary construction to present the housing unit 10 on a lot of minimum size. As an optional part, a third home part 18 can be used to form a side projection on part 12 and thereby another embodiment of the invention; however, part 18 is not essential to the basic construction of housing unit 10.

Parts 12, 14 and 18 can either be mobile or modular. If they are mobile, they are provided with wheel and axle assemblies and are towed from a manufacturing or other site to a building site where they are interconnected during construction of the housing unit 10. Wheel and axle assemblies 20, 22 and 24 are shown in dashed lines in FIG. 1 for parts 12, 14 and 18, respectively.

If parts 12, 14 and 18 are modular, they may or may not have wheels but, if they do not, they might be hauled on flatbed trucks, trailers or removable chassis from a manufacturing or other site to a building site. To this end, each of the three parts is provided with an essentially flat bottom although the bottom can be formed of a number of floor beams or joists typically having flat bottom surfaces. In the alternative, the modular parts can even be carried on skids.

Garage 16 is erected at the building site and includes a garage housing 26 and a concrete or other slab put in place at the building site before garage housing 26 is formed over the slab. In a first embodiment of the housing unit, one sidewall of the garage housing 26 is secured to the adjacent sidewall of part 12 (FIGS. 9 and 10) and one end wall of the garage housing 26 is secured to the adjacent end wall of part 14. These side and end walls of garage housing 26 are load bearing in the sense that they help to support the adjacent portions of parts 12 and 14 in the event that there is ground subsidence due to settling of the soil. In a second embodiment, the garage is connected to the adjacent home part merely by a flashing (FIG. 10*a*) which permits limited vertical movement of the home parts relative to the garage, such as movement due to ground subsidence.

FIG. 2 illustrates parts 12 and 14 connected together and garage 16 attached to parts 12 and 14. If part 18 is used, it is attached to one side of part 12 in the manner shown in FIG. 2. The attachment points are indicated by the numerals 30 and any suitable attachment means, such as a conventional fastener, can be used for this purpose. The attachments will generally be made along the roof and floor lines common to the upper and lower extremities, respectively, of parts 12 and 14. Similarly, attachments points 30 at which parts 12 and 18 are connected can be along common roof and floor lines or other suitable junctions of these two parts.

One of the advantages of housing unit 10 is the way in which it can be positioned on a relatively long and narrow lot of a mobile home park or housing subdivision. This feature is shown in FIG. 2*a*, wherein three lots denoted by the numerals 32, 34 and 36 are located side-by-side, lot 32 having a boundary line 37 at the left side of the lot and sharing a common boundary with lot 34 at lot line 38. Similarly, lot line 40 is common to lots 34 and 36, and lot 36 has a right side boundary 42.

In a mobile home park, each of the housing units 10 shown in FIG. 2*a* can have one sidewall adjacent to or on the lot line. For purposes of illustration, the side boundary of each of the three housing units of FIG. 2*a* is the right sidewall of the corresponding garage 16. As shown in FIG. 2*a*, the sidewall of each garage is on the corresponding lot line 38, 40 or 42. If building codes permit, this feature provides a maximum amount of open or useable space between each housing unit 10 and the lot line to the left of it with reference to FIG. 2*a*. Thus, housing unit 10 adjacent to lot line 38 will have a maximum space 44 between the housing unit and lot line 37 notwithstanding the presence of the projecting part 18 coupled to the side of corresponding part 12. Similarly, building unit 10 adjacent to lot line 40 will have a maximum space 46 between it and lot line 38, and housing unit 10 adjacent to lot line 42 will have a maximum space 48 between it and lot line 40. Spaces 44, 46 and 48 can be used for many purposes and need not necessarily be used for parking because of the presence of garage 16 forming an essential part of the housing unit on the corresponding lot.

Another feature of the housing unit of the present invention is the fact that its entire right side, including sidewall 50 of part 14 and sidewall 52 of garage 16 has no door, window or other openings. Thus, this feature assures complete privacy in the open or useable space to the right of each housing unit with reference to FIG. 2*a*. For instance, privacy from the occupants of housing unit 10 of lot 32 is assured in space 46 of lot 34. Similarly, privacy in space 48 of lot 36 is assured because the entire right sidesall of housing unit 10 on lot 34 has no openings of any type to permit viewing of space 48 from within the housing unit.

FIG. 3 shows a typical floor plan which might be used in housing unit 10 when part 18 is not used. The various partitions as shown in FIG. 3 divide the interior of the building unit into several rooms, such as a living room, several bedrooms, a bathroom, a kitchen and several closets. An entry is provided between the garage and the interior of the space defined by part 12 or part 14. Other arrangements of partitions and rooms can be used, if desired.

FIGS. 4, 5 and 6 show housing unit 10 of FIG. 3 in a finished condition with siding, installed windows and doors, and a peaked roof. The garage, in finished condition, is shown in dashed lines in FIGS. 4–6.

FIG. 4 illustrates sidewall 50 of part 14 free of windows, doors and other openings which can permit viewing into the open or useable space adjacent to this sidewall. The roof is shown in FIG. 4 as being provided with a pair of skylights; however, these do not permit a view of the adjacent open or useable space and do not impair the privacy enjoyed in such space. Sidewall 52 of garage 16 is shown in dashed lines in FIG. 4, but it is understood that this sidewall has no openings as described above.

FIG. 5 illustrates that the opposite side of the housing has windows and doors permitting a view and access, respectively, to the adjacent open or useable space. The entrance to the housing unit is typically from this space. FIG. 6 is an end elevational view of the housing unit of FIG. 3 with the garage in dashed lines to illustrate the finished appearance of the housing unit notwithstanding the fact that it is formed from three parts, two of which are mobile or modular, the third part being the garage.

FIG. 7 is a floor plan of housing unit 10 when the same uses part 18 attached to part 12. This permits the housing unit to have additional floor space and permits greater versatility in the interior arrangement of partitions and walls to form rooms and other spaces. A side elevational view of the housing unit of FIG. 7, looking from the adjacent open or useable space, such as space 44 of lot 32, is shown in FIG. 8, wherein the housing unit is provided with a finished appearance by virtue of the addition of siding and a roof of parts 12, 14 and 18. Garage 16 is shown in dashed lines in FIG. 8 to illustrate the way the roof of the garage projects relative to the projection of the roof of part 12. Housing unit 10 of FIGS. 7 and 8 has one entire side free of doors, windows and other openings; thus, it will have an appearance at least substantially the same as that shown in FIG. 4

FIG. 9 illustrates the details of a typical garage, which can be a one-car or two-car garage, the latter being erected on site, typically, after parts 12 and 14 have been moved into positions adjacent to each other and interconnected by fasteners at attachment points 30 as described above with respect to FIG. 2

Slab 28 of the garage is typically four to six inches in thickness and has a footing 60 extending downwardly from the slab and extending about its outer periphery. The footing is embedded in a trench 62 (FIG. 10) formed in the ground 64.

Garage 16 has, in addition to sidewall 52, a second sidewall 70, a first end wall 72, and a second end wall (not shown) having a door opening. A suitable garage door (not shown) can be used to close this door opening and the door can be opened to permit a vehicle to be driven in and out of the garage.

In the embodiment of the housing unit shown in FIGS. 9 and 10, walls 70 and 72 are load bearing in the sense that they are coupled to adjacent portions of parts 12 and 14 so as to support these parts in the event of movement of the ground tending to allow the parts 12 and 14 to subside or to be raised. These walls thus substantially prevent relative movement between the garage and parts 12 and 14 such as might otherwise occur when the ground beneath the housing unit subsides or raises.

In a second embodiment, the garage is coupled only by flashing to adjacent parts 12 and 14. As shown in FIG. 10*a*, a flashing part 73*a* on home part 12 overlaps and is shiftable relative to a flashing part 73*b* on the garage. This feature is used when ground subsidence is not a problem or where building codes do not permit the garage to be connected in load-bearing relationship as in FIGS. 9 and 10.

Each of garage walls 52, 70 and 72, while typically formed at the building site can be brought in from a manufacturing or other site. Each of the walls is in the form of a framework defined, for instance, by two-by-four studs 76 (FIG. 10) which are interconnected in any suitable way. In the first embodiment (FIGS. 9 and 10) mentioned above, sidewall 70 has a pair of upper and lower nailing strips 78 and 79, typically of one-by-eight strips of wood, placed in notches in the studs of the wall framework. These nailing strips are nailed to the corresponding side portion 80 of part 12 (FIG. 9). Similarly, end wall 72 will be provided with nailing strips 78 and 79 nailed to the adjacent end wall of part 14. Since walls 70 and 72 rest on and are supported by slab 28, they will, by virtue of their connection with parts 12 and 14, support at least part of the weight of these two parts in the event of subsidence of the ground beneath the parts.

Parts 12 and 14 are mounted on removable or other piers 81 which may be arranged in the manner shown in FIG. 11. Other patterns for the piers can be used if desired. A typical pier is of the type shown in FIG. 12 and includes a conical base 82, an adjustment device, such as a jack or wedge 84, and a structural member, such as an I-beam 86, on the upper end of jack 84. The corresponding home part, such as part 12, rests on the upper flange of the I-beam and tie-down cables (not shown) can be used to secure the mounting, if desired.

In erecting a housing unit 10, parts 12 and 14, and part 18 if it is used, are moved to a building site and placed adjacent to each other. Initially, part 14 can first be moved so that it is in the desired position with reference to the adjacent lot line, such as lot line 40 of lot 34 (FIG. 2*a*). The required number of piers are then moved beneath part 12 and are jacked up until part 14 is supported on its piers. Then, part 14 is moved into a position directly adjacent to part 12 and piers are moved under part 14 and jacked up until they properly support part 14 so that it is level with and in mating relationship to part 12. Then the two parts are connected together by fasteners at attachment points 30 so that they form an interconnected housing. If the parts 12 and 14 are mobile, the wheels can then be removed from the axles thereof and stored for subsequent use or recycled. If part 18 is used, it will then be moved into position adjacent to part 12, jacked up on piers and then connected to part 12 by fasteners at corresponding attachment points 30.

After parts 12 and 14 have been placed on piers and connected together, slab 28 is then poured in place to form the floor of garage 16. When walls 52, 70 and 72 are formed individually on the ground and tilted up into place. In forming the first embodiment of the housing unit, walls 70 and 72 will be connected, to the adjacent wall portions of parts 12 and 14 by nailing strips 78 and 79 so that walls 72 as to become load bearing members for parts 12 and 14. In the second embodiment, flashing parts 73*a* and 73*b* are used to connect parts 12 and 14 to garage 16. After the erection of walls 52, 70 and 72, a roof is placed on the walls above slab 28. Housing unit 10 is then basically erected and finishing materials, such as siding, a peaked roof, shingles, and eaves are then applied to the housing unit to finish it. During this time, the interior of the housing unit can be provided with partitions, rugs, wall coverings an other finishing material, following which the housing unit will be ready for occupancy and full enjoyment of the open space between it and the next adjacent housing unit.

We claim

1. A housing unit comprising: at least a pair of elongated home parts, each home part having a pair of opposed sides, one of the home parts being longer than the other home part, the home parts initially being transportable independently of each other onto a lot; means beneath each home part for supporting the same in side-by-side relationship on the lot with a side of one home part being directly adjacent to a side of the other home part; means interconnecting the adjacent sides of the home parts when the same are supported by said supporting means; and a garage adjacent to the home parts and in longitudinal alignment with the other home part, said garage having a floor slab, a pair of sidewalls and an end wall, the sidewalls and end wall being independent of the home parts and being supported on the floor slab, said garage having means coupled to the home parts for permitting the home parts to move up and down and the garage sidewalls and end wall to remain stationary on the floor slab as the lot heaves and subsides due to earth movement.

2. A housing unit as set forth in claim 1, wherein one side of the garage and one side of the other home part are free of openings.

3. A housing unit comprising: a pair of elongated home parts, one of the home parts being longer than the other home part, the home parts initially being transportable independently of each other onto a lot; a number of spaced piers beneath each home part for supporting the same in side-by-side, substantially abutting relationship to each other on the lot with respective first ends of the home parts adjacent to each other, the second ends of the home parts being spaced from each other; means interconnecting the home parts at spaced locations along the junction thereof when the home parts are supported by said piers; a garage adjacent to the home parts and in longitudinal alignment with the other home part, said garage having a floor slab, a pair of sidewalls and an end wall, the sidewalls and the end wall being independent of the home parts and being supported on the floor slab; first means securing one sidewall of the garage to the adjacent side of said one home part; and second means securing said end wall to the adjacent end of the other home part, said one sidewall and the end wall being in load-bearing relationship to adjacent portions of respective home parts, whereby the load of the adjacent portions of the home parts is borne by the one sidewall and the end wall of the garage as the lot heaves and subsides due to earth movement, one side of the other home part and the other sidewall of the garage being free of openings therethrough.

4. A housing unit comprising: a pair of elongated home parts, one of the home parts being longer than the other home part, the home parts initially being transportable independently of each other onto a lot; a number of spaced piers beneath each home part for supporting the same in side-by-side, substantially abutting relationship to each other on the lot with respective first ends of the home parts adjacent to each other, the second ends of the home parts being spaced from each other; means interconnecting the home parts at spaced locations along the junction thereof when the home parts are supported by said piers; a garage adjacent to the home parts in longitudinal alignment with the other home part, said garage having a floor slab, a pair of sidewalls and an end wall, the sidewalls and the end wall being independent of the home parts and being supported on the floor slab; and means including a flashing including a pair of relatively shiftable flashing parts coupled together, said flashing permitting the garage sidewalls and end wall to remain stationary on the floor slab as the lot heaves and subsides due to earth movement, on side of the other home part and the other sidewall of the garage being free of openings therethrough.

5. A housing unit comprising: at least a pair of elongated home parts, each home part having a pair of opposed sides, one of the home parts being longer than the other home part, the home parts initially being transportable independently of each other onto a lot; means beneath each home part for supporting the same in side-by-side relationship on the lot with a side of one home part being directly adjacent to a side of the other home part; means interconnecting the adjacent sides of the home parts when the same are supported by said supporting means; and a garage adjacent to the home parts and in longitudinal alignment with the other home part, said garage having a floor slab, a pair of sidewalls and an end wall, the sidewalls and end wall being independent of the home parts and being supported on the floor slab; first means connecting one of the sidewalls of the garage to said one home part; and second means connecting the end wall of the garage to the other home part, each of said first means and said second means including a pair of vertically spaced strips, and means securing the strips of each pair to the adjacent portion of the corresponding home part, said strips and said securing means causing said one sidewall and the end wall to be in load-bearing relationship to respective home parts to thereby permit the garage to operate essentially as an attached garage and to allow the garage sidewalls and end wall to remain stationary on the floor slab as the lot heaves and subsides due to earth movement.

6. A housing unit comprising: at least a pair of elongated home parts, each home part having a pair of opposed sides, one of the home parts being longer than the other home part, the home parts initially being transportable independently of each other onto a lot; means beneath each home part for supporting the same in side-by-side relationship on the lot with a side of one home part being directly adjacent to a side of the other home part; means interconnecting the adjacent sides of the home parts when the same are supported by said supporting means; and a garage adjacent to the home parts and in longitudinal alignment with the other home part, said garage having a floor slab, a pair of sidewalls and an end wall, the sidewalls and end wall being independent of the home parts and being supported on the floor slab, there being flashing between the garage and the home parts, the flashing including a pair of relatively shiftable flashing parts coupled together for permitting the garage to operate essentially as an attached garage and to allow the garage sidewalls and end wall to remain stationary on the floor slab as the lot heaves and subsides due to earth movement.

7. A housing construction for a number of adjoining lots with each pair of lots having a common lot line comprising: a number of housing units, there being a housing unit for each lot, respectively, each housing unit including a pair of elongated home parts, one of the home parts being longer than the other home part, the home parts initially being transportable independently of each other onto the respective lot; a number of spaced piers beneath the home parts of each housing unit for supporting the home parts in side-by-side substantially abutting relationship to each other on the respective lot with respective first ends of the home parts adjacent to each other, the second ends of the home parts being spaced from each other and with one side of the other home parts at least adjacent to a corresponding common lot line; means interconnecting the home parts of each housing unit at spaced locations along the junction of the home parts when the latter are supported by said piers; a garage for each housing unit, respectively, each garage being adjacent to respective ends of the corresponding pair of home parts in longitudinal alignment with said other home part of the pair, said garage having a floor slab, a pair of sidewalls and an end wall, the sidewalls and the end wall being independent of the home parts and being supported on the floor slab; and flashing between the garage and the home parts, the flashing including a pair of relatively shiftable flashing parts permitting the garage to operate essentially as an attached garage and allowing the garage sidewalls and end wall to remain stationary on the floor slab as the lot heaves and subsides due to earth movement, the side of each housing unit adjacent to the corresponding common lot line being free of openings therethrough whereby access to or observation of a lot from the housing unit of the next adjacent lot is prevented.

* * * * *